US006363544B1

(12) United States Patent
Ryan

(10) Patent No.: US 6,363,544 B1
(45) Date of Patent: Apr. 2, 2002

(54) SPRING BIASED DRAIN CLOSURE

(76) Inventor: Ronald J. Ryan, 1101 NE. Florence Ave., Lee's Summit, MO (US) 64086

( * ) Notice: Subject to any disclaimer, the term of this patent is extended or adjusted under 35 U.S.C. 154(b) by 0 days.

(21) Appl. No.: 09/812,742

(22) Filed: Mar. 20, 2001

(51) Int. Cl.[7] ..... A47K 1/14
(52) U.S. Cl. ..... 4/287; 4/689
(58) Field of Search ..... 4/286, 287, 295, 4/688, 689, 693

(56) References Cited

U.S. PATENT DOCUMENTS

| | | | | | |
|---|---|---|---|---|---|
| 1,746,683 | A | * | 2/1930 | Schifter | 4/287 |
| 1,811,170 | A | * | 6/1931 | Brotz | 4/689 |
| 2,075,443 | A | * | 3/1937 | Kirschner et al. | 4/287 |
| 2,479,485 | A | * | 8/1949 | Frank | 4/287 |
| 3,468,512 | A | * | 9/1969 | Politz | 4/295 X |
| 3,813,708 | A | | 6/1974 | Hamburg | |
| 3,995,333 | A | | 12/1976 | Stephens | |
| 4,007,500 | A | | 2/1977 | Thompson et al. | |
| 4,103,372 | A | | 8/1978 | Cushera | |
| 4,144,599 | A | | 3/1979 | Cushera | |
| 4,276,662 | A | | 7/1981 | Young | |
| 4,339,832 | A | | 7/1982 | Cushera | |
| 4,359,788 | A | | 11/1982 | Liou | |
| 4,369,531 | A | | 1/1983 | Swanson | |
| 4,412,361 | A | | 11/1983 | Cushera | |
| 4,447,918 | A | | 5/1984 | Cushera | |
| 4,597,112 | A | | 7/1986 | Cushera | |
| 4,720,877 | A | | 1/1988 | Watts | |
| 4,764,993 | A | | 8/1988 | Oropallo | |
| 4,908,883 | A | | 3/1990 | Rivera | |
| 4,926,507 | A | | 5/1990 | Craig et al. | |
| 5,072,461 | A | | 12/1991 | Logsdon | |
| 5,749,561 | A | * | 5/1998 | Worington | 4/295 X |
| 5,758,368 | A | | 6/1998 | Ball | |
| 5,832,544 | A | | 11/1998 | Pan | |
| 5,832,545 | A | | 11/1998 | Pan | |
| 5,881,397 | A | | 3/1999 | Hobbs | |
| 6,138,290 | A | | 10/2000 | Lin | |

FOREIGN PATENT DOCUMENTS

| | | | |
|---|---|---|---|
| WO | 9116847 | * 11/1991 | 4/688 |

* cited by examiner

*Primary Examiner*—Charles E. Phillips
(74) *Attorney, Agent, or Firm*—Shughart Thomson & Kilroy P.C.

(57) ABSTRACT

A drain closure is provided for mounting in the drain hole of a vessel such as a bathtub. The closure includes a strainer for mounting within the drain hole. A post extends upwardly from the strainer. A pair of bayonet pins extend outwardly from the post. The drain closure further includes a drain plug having a central aperture in sliding engagement with the post. The plug includes a pair of bayonet slots positioned for slidingly engaging the bayonet pins. An annular plug flange on the plug extends radially outwardly from the plug. An elastomeric seal is positioned beneath the plug flange for sealingly engaging the strainer flange. A cap is positioned on the drain plug over the top of the central aperture. A conical helical spring is positioned between the upper end of the post and the cap and acts to bias the plug upwardly away from the strainer.

32 Claims, 2 Drawing Sheets

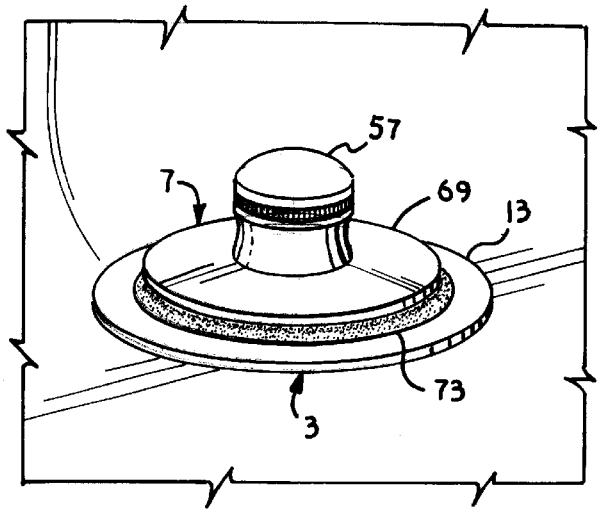
Fig. 1.
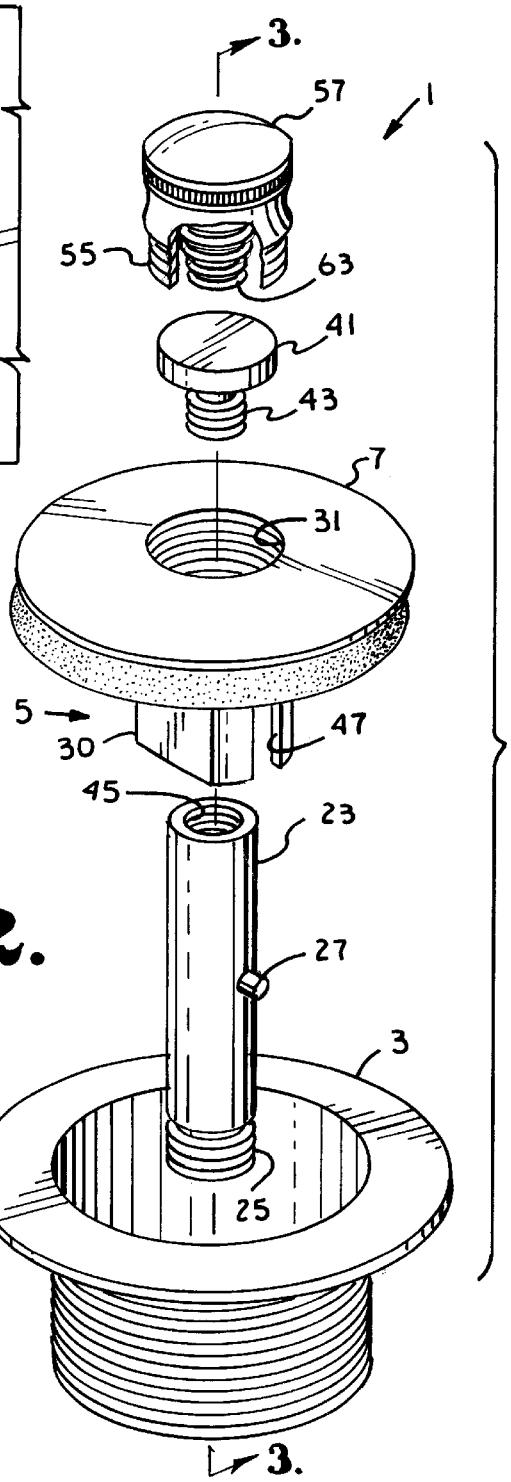
Fig. 2.
Fig. 7.
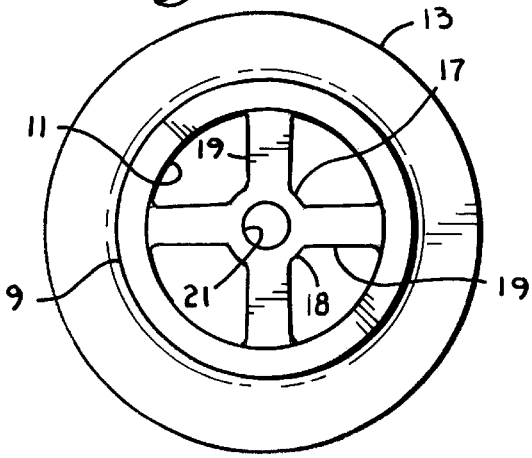

SPRING BIASED DRAIN CLOSURE

BACKGROUND OF THE INVENTION

1. Field of the Invention

The invention relates to spring biased drain closures for fluid containing vessels such as bathtubs and lavatories, and in particular to such a closure having a slidably attached drain plug and a latching mechanism for retaining the plug in a sealing position.

2. Description of the Related Art

Vessels such as bathtubs and lavatories are generally provided with a drain hole through which liquid retained within the vessel can be released. The drain hole is selectively opened and closed by a drain closure mechanism. A wide variety of drain closures have been previously disclosed, ranging from simple rubber plugs to lever operated devices.

Drain closures of the type having a plug or stopper which is vertically moveable between a sealed position and an open position but in which the plug or stopper is not easily removable from the drain opening are well known and commonly used in public establishments such as hotels and motels. Such a device is disclosed by U.S. Pat. No. 5,072,461 issued to Duane D. Logsdon and entitled Moveable Fitting Members for Use with Drain Fittings. The Logsdon patent shows a drain closure or "fitting member" having a vertical guide post which threadably engages a drain fitting or strainer mounted in the drain hole. The guide post includes a bayonet pin or cross pin which extends outwardly from the guide post in opposing transverse directions. A plug or fitting member body is slidably mounted on the guide post to selectively close the drain opening. A nut attached to the top of the post prevents the plug from being removed. The plug includes a series of longitudinal slots or steps which engage the cross pin to hold the plug in the open position or in positions intermediate the open and closed position. The plug is held in the closed position by the weight of the plug and the weight of the water acting on the plug.

The Logsdon patent further discloses an alternative embodiment having lateral or bayonet slots which engage the bayonet pin to retain the plug in the open position or in positions intermediate the open and closed position. Once again, however, no lateral slot is provided for the closed position of the plug, which is only retained in the closed position by the force of gravity.

This device has at least two shortcomings: first, no provision is made for positively retaining the plug in the closed position; and second, the plug must be manually lifted into the open position against the weight of the water and twisted into the proper orientation to be retained in the open position. This second task can be difficult to accomplish by a user with wet, slippery hands. The configuration of the closure mechanism could also be problematic because a person taking a shower in a tub/shower combination using the device could easily kick or step on the plug and inadvertently knock it into the closed position, causing the water level to unexpectedly rise.

A solution to these problems is to produce such a device wherein the plug is biased into the open position and selectively positively retained in the closed position. Previous drain closures incorporating this feature (known as "pop-up" closures) are disclosed by U.S. Pat. No. 4,764,993 to Robert A. Oropallo and U.S. Pat. Nos. 4,103,372; 4,144,599; 4,339,823; 4,412,361; and 4,447,918 to Casper Cuschera. In these devices, the center post generally includes a tooth with a ramped upper surface and a generally horizontal lower surface. The plug includes a locking pin oriented to slide over the ramped upper surface on downward movement of the plug and to engage the lower surface as the plug begins to move upward. A compression spring is positioned between the top of the post and the plug to urge the plug upwardly. To open the closure, the user pushes downward on the plug against the bias of the spring and tilts it slightly to disengage the locking pin from the post tooth.

Pop-up closures of this type can be somewhat difficult for uninitiated users to operate. In order to properly open or close the device, the user must push down on the proper spot on the plug to tilt the plug in the correct direction to cause the locking pin to engage or disengage the post tooth. If the incorrect part of the plug is depressed, the plug will tilt in the wrong direction and will not lock or release as desired.

What is needed is a simple spring biased drain closure device which is easy to operate and relatively simple to manufacture and assemble.

SUMMARY OF THE INVENTION

The present invention comprises a drain closure for mounting in the drain hole of a vessel such as a bathtub or lavatory. The closure includes a strainer sized and shaped to fit within the drain hole and sealingly engage the vessel. The strainer includes an upstanding tubular wall defining a strainer passage and a spider spanning said strainer passage proximate the lower end of the tubular wall. At the upper end of the stainer, an annular flange extends radially outwardly from the tubular wall.

A post threadably engages a threaded receiver in the spider and extends upwardly therefrom in concentric orientation with the strainer passage. A pair of bayonet pins extend outwardly from the post in opposed transverse directions intermediate its upper and lower ends. The drain closure further includes a drain plug having a central aperture in sliding engagement with the post. The plug includes a pair of bayonet slots positioned in communication with the central aperture for slidingly engaging respective ones of the bayonet pins. Each bayonet slot includes a longitudinal portion extending upwardly from a lower extremity of the drain plug and a locking portion intersecting the longitudinal portion and extending laterally therefrom. An annular plug flange on the plug extends radially outwardly from the plug and is sized and shaped to cover the strainer passage. An elastomeric seal is positioned beneath the plug flange for sealingly engaging the strainer flange.

A cap is connected to the drain plug over the top of the central aperture. The cap includes an internal cavity in communication with the central aperture. A conical helical spring is positioned within the internal cavity such that a lower end of the spring engages the upper end of the post and the upper end of the spring engages the cap. The spring acts to bias the plug upwardly away from the strainer.

To close the drain closure, a user simply pushes down on the plug against the bias of the spring and twists the plug in a clockwise direction in order to rotate the locking portions of the bayonet slots onto the bayonet pins. To open the drain closure, the user need only rotate the plug slightly in a counterclockwise direction; the spring bias will urge the plug upward as soon as the bayonet pins encounter the longitudinal portions of the bayonet slots.

BRIEF DESCRIPTION OF THE DRAWINGS

FIG. 1 is a perspective view of a drain closure embodying the present invention mounted in the drain hole of a bathtub.

FIG. 2 is an exploded perspective view of the drain closure.

FIG. 7 a bottom plan view of the drain closure.

DETAILED DESCRIPTION OF THE PREFERRED EMBODIMENT

Figure 3:
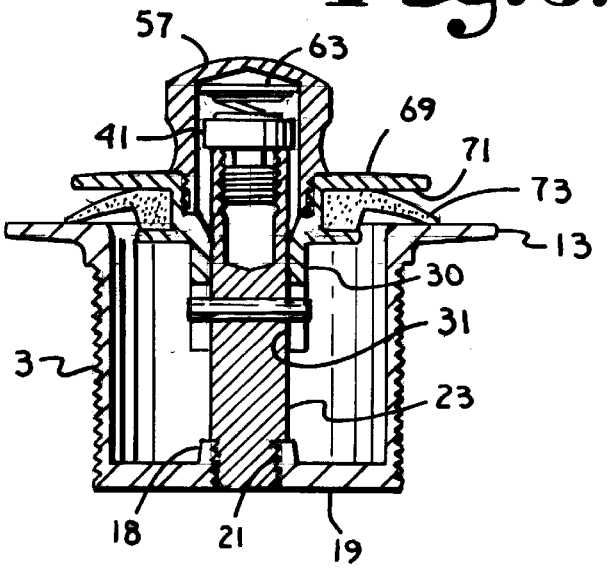
FIG. 3 is a cross-sectional view of the drain closure in the sealed position taken generally along line 3—3 in FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 designates a spring biased drain closure embodying the present invention. As shown in FIG. 2, the drain closure 1 generally comprises a strainer 3 and a drain plug mechanism 5 including a plug 7 which selectively engages the strainer 3 to prevent liquid from passing therethrough.

The strainer 3 is sized and shaped for mounting in a drain hole of a vessel such as a bathtub or lavatory and includes an upstanding tubular sidewall 9 defining a strainer passage 11. An annular flange 13 extends radially outwardly from the sidewall 9 proximate the top end thereof The outer surface of the sidewall 9 includes an external thread 15 which accepts a flange nut or fitting (not shown) for securing the strainer 3 to the vessel and drawing the flange 13 into sealing engagement with an inside surface of the vessel proximate the drain hole. The thread 15 also mates with a fitting for connecting the strainer 3 to a drain line.

Referring to FIG. 7, the strainer 3 includes a spider 17 which spans the strainer passage 11 proximate the lower end of the sidewall 9. The spider 17 includes a body 18 and a plurality of legs 19 (four shown) which connect the spider body 18 to the strainer sidewall 9. The spider body 18 includes a threaded receiver 21 oriented concentrically with the strainer passage 11. The receiver 21 serves as an attachment point for connecting the drain plug mechanism 5 to the strainer 3.

Referring again to FIG. 2, the drain plug mechanism 5 includes a post 23 which extends upwardly from the spider 17 of the strainer 3. The lower end of the post 23 includes an external thread 25 which engages the threaded receiver 21. A pair of bayonet pins 27 extend outwardly from the post 23 intermediate the top and bottom ends thereof in linearly opposed directions. The pins 27 may be opposite ends of a single rod 29 passing through the post 23.

Figure 5:
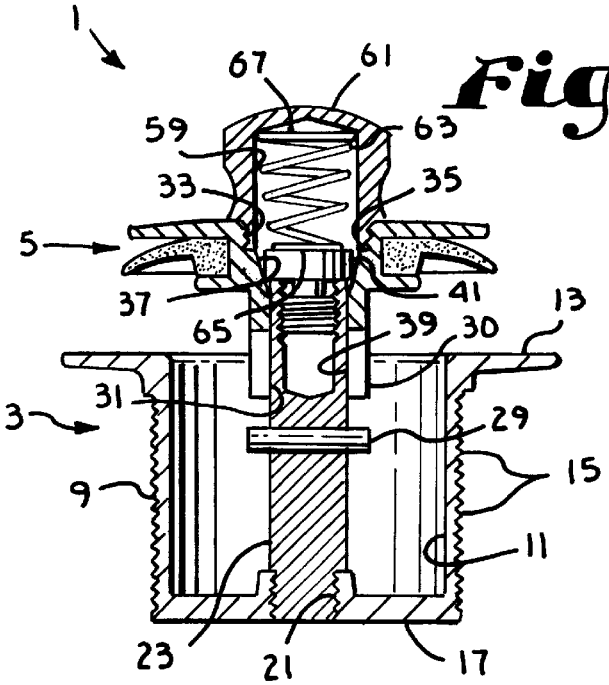
FIG. 5 is a cross-sectional view of the drain closure in the open position taken generally along line 3—3 in FIG. 2.

The plug 7 includes a hollow stem or hub 30 with a central aperture 31 extending therethrough from a top to bottom thereof As seen in FIG. 5, the central aperture 31 includes an internally threaded portion 33 proximate the top of the plug 7, the threaded portion 33 having a first diameter which is greater than the diameter of the lower portions of the aperture 31. At the bottom of the threaded portion 33, the aperture 31 is abruptly reduced to a second diameter, creating an annular shoulder 35. Below the shoulder 35 is a tapered portion 37 of the aperture 31 wherein the diameter of the aperture 31 transitions inwardly from the second diameter to a yet smaller third diameter. Below the tapered portion 37 of the aperture 31 is a bottom portion 39 wherein the diameter remains generally constant at said third diameter, which is sized to slidingly receive the post 23.

The post 23 includes a head 41 having a diameter greater than the third diameter of the plug aperture 31 but less than the second diameter, which allows the post head 41 to fit within the tapered portion 37 of the plug aperture 31. The post head 41 will not fit through the bottom portion 39 of the plug aperture 31 and this interference prevents the plug 7 from being easily removable from the post 23. In order to simplify assembly of the drain plug mechanism 5, the head 41 may be removably connected to the post 23. The head 41 is therefore shown as having an externally threaded shaft 43 which engages an internally threaded axial receiver 45 in the upper end of the post 23 for securing the head 41 to the post 23.

Figure 4:
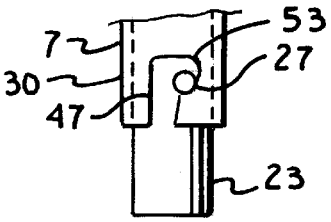
FIG. 4 is a partial side view of the post and plug of the drain closure showing the orientation of a bayonet pin and bayonet slot when the closure is in the sealed position.
Figure 6:
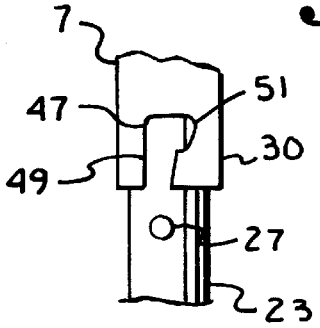
FIG. 6 Us a partial side view of the post and plug of the drain closure showing the orientation of a bayonet pin and bayonet slot when the closure is in the open position.

Referring to FIGS. 4 and 6, a pair of bayonet slots 47 are cut into the hub 30 of the plug 7 so as to communicate with the bottom portion 39 of the central aperture 31 and be slidingly engageable with the bayonet pins 27 of the post 23. Each bayonet slot 47 includes a first or longitudinal portion 49 and a second or locking portion 51 which extends laterally from the longitudinal portion 43. The longitudinal portions 49 of the slots 47 preferably taper outwardly proximate the locking portions 51 so that the bayonet pins 27 can be more easily disengaged from the locking portions 51. The locking portions 51 of the slots 47 are of a height which is greater than the diameter of the pins 27, creating an offset area 53 between a pin 27 captured within the locking portion 51 and the top edge of the locking portion 51. The offset area 53 allows the pin 27 a limited amount of vertical movement within the locking portion 51 of the slot 47.

As seen in FIGS. 3 and 5, the threaded portion 33 of the plug aperture 31 receives a threaded end 55 of a cap or knob 57 which extends upwardly from the plug 7. The cap 57 includes an internal cavity 59 which communicates with the plug aperture 31 and a top wall 61 positioned above the internal cavity 59. The outer surface of the cap 57 is preferably knurled or textured in such a fashion that it can be easily gripped and turned, even when wet.

A compression spring 63 is positioned within or extends into the internal cavity 59 of the cap 57 such that a lower end 65 of the spring 63 engages the post head 41 and an upper end 67 of the spring 63 engages the top wall 61 of the cap 57. The spring 63 is preferably sized such that a substantial portion of the spring 63, or almost all, if not all, of the spring 63 fits completely within the internal cavity 59 of the cap or knob 57. The spring 63 acts to bias the cap 57 and attached plug 7 upwardly relative to the post 23 and away from the strainer 3. The spring 63 is preferably a conical helical spring wherein the lower end 65 is smaller in diameter than the upper end 67. A conical spring 63 can compress into a smaller area than a standard helical spring because the coils of the smaller end will fit inside the coils of the larger end. This feature allows the internal cavity 59 of the cap 57 to be shorter than would be required with a standard helical spring, and therefore does not require that the cap 57 be excessively tall.

The plug 7 further includes an annular plug flange 69 which extends radially outwardly from the plug stem 30 proximate the upper end thereof The flange 69 includes a lower surface 71. An elastomeric sealing ring 73 is affixed to the plug 7 below the flange and adjacent the lower surface 71 thereof The sealing ring 73 is concave, curving downward toward the strainer flange 13 to facilitate sealing between sealing ring 73 and strainer flange 13.

The plug 7 is moveable along the post 23 between a sealed position (FIG. 3), wherein the sealing ring 73 connected thereto is in contact with the strainer flange 13 and closes off the strainer passage 11, and an open position (FIG. 5) wherein a space or gap exists between the sealing ring 73 and strainer flange 13, allowing liquid to flow therebetween. The plug 7 is biased into the open position by the spring 63.

As shown in FIGS. 5 and 6, it is preferable that the stem 30 be of such a length that the bayonet pins 27 are below the plug 7 and not positioned within the bayonet slots 47 when the plug 7 is in the open position. This feature serves to make it more difficult to unscrew the post 23 from the strainer receiver 21 by turning the plug 7 because a person is required to simultaneously push down on the plug 7 and turn in order to accomplish the task. Such an arrangement is advantageous because it prevents a user from accidently separating the drain plug mechanism 5 from the strainer 3 and helps to deter thieves who might want to take the drain plug mechanism 5 from a public establishment such as a motel.

In use, the drain closure 1 serves to selectively seal the hole of a vessel such as a bathtub or lavatory as shown in FIG. 1. To seal the drain hole so that liquid can be retained within the vessel, a user pushes downwardly on the plug 7 and turns the plug 7 in a clockwise direction by grasping the knob 57. Clockwise rotation of the plug 7 causes the locking portions 51 of the bayonet slots 47 to come into sliding engagement with the respective bayonet pins 27. Upon the user releasing the knob 57, the action of the spring 63 biases the plug 7 upwardly such that bottom edges of the slot locking portions 51 engage the pins 27 and thereby retain the plug 7 in the sealed position.

To open the drain closure 1 and let a liquid within the vessel flow out through the drain hole, the user simply applies a counterclockwise rotation to the plug 7 via the knob 57. Counterclockwise rotation of the plug 7 causes the causes the slot locking portions 51 to slide out of engagement with the bayonet pins 27. When the pins 27 encounter the longitudinal portion 49 of the slots 47, the spring 63 will bias the plug 7 upwardly and into the open position. If the longitudinal portions 49 of the slots 47 are outwardly tapered as shown in FIGS. 4 and 6, the amount of counterclockwise rotation required to release the plug 7 will be substantially lessened, allowing a user to move the plug 7 into the open position with a slight tap or nudge such as could be applied with a foot if the closure 1 is installed in a bathtub drain.

It is to be understood that while certain forms of the present invention have been illustrated and described herein, it is not to be limited to the specific forms or arrangement of parts described and shown. For example, the slot locking portions 51 are described and depicted herein as being arranged in such a fashion that the plug 7 is moved into the sealed position with a clockwise movement of the plug 7. It is foreseen that the closure I could easily be modified such that the plug 7 is locked with a counterclockwise movement by having the locking portions 51 of the bayonet slots 47 extend from the longitudinal portions 49 in the opposite direction from that shown. It is, however, preferable that the motion required to lock the plug 7 be in the opposite rotational direction from the direction of the threads on the knob 57 so that the knob 57 will not unscrew while the user is attempting to seal the closure 1.

What is claimed and desired to be secured by Letters Patent is as follows:

1. A drain plug mechanism for a vessel having a drain hole, said drain plug mechanism for use with a strainer mounted within the drain hole in sealing engagement with the vessel, the strainer including a strainer passage and a threaded receiver positioned within the strainer passage; said drain plug mechanism comprising:

a) a post having a lower end with external threads for engaging the threaded receiver such that said post extends upwardly therefrom;

b) a plug slidably mounted on said post and selectively closing the strainer passage;

c) a bayonet mount for latching said plug in a sealed position relative to the strainer;

d) a cap connected to said plug above said post; and e) a spring positioned between said post and said cap urging said plug away from said strainer.

2. The drain plug mechanism as in claim 1, wherein said spring is a conical helical spring.

3. The drain plug mechanism as in claim 1, wherein said spring extends completely within said cap.

4. The drain plug mechanism as in claim 1, wherein said bayonet mount comprises a pair of bayonet pins extending outwardly from said post in opposing transverse directions and a pair of bayonet slots in said plug, each of said bayonet slots including a first portion extending upwardly from a lower extremity of said plug and a second portion intersecting said first portion and extending laterally therefrom, said bayonet slots slidably engageable with said bayonet pins.

5. The drain plug mechanism as in claim 4, wherein said bayonet pins are positioned below said lower extremity of said plug when said plug is urged away from said strainer by said spring.

6. The drain plug mechanism as in claim 4, wherein each said bayonet slot first portion tapers outwardly toward the respective second portion proximate said intersection with said respective second portion.

7. A drain closure comprising:

a) a strainer for mounting in a drain hole of a vessel, said strainer including a strainer passage;

b) a post extending upward from said strainer;

c) a plug slidably mounted on said post and selectively closing said strainer passage;

d) a bayonet mount for latching said plug in a sealed position relative to said strainer;

e) a cap connected to said plug above said post; and f) a spring positioned between said post and said cap urging said plug away from said strainer.

8. The drain closure as in claim 7, wherein said spring extends completely within said cap.

9. The drain closure as in claim 7, wherein said spring is a conical helical spring.

10. The drain closure as in claim 7, wherein said bayonet mount comprises a pair of bayonet pins extending outwardly from said post in opposing transverse directions and a pair of bayonet slots in said plug, each of said bayonet slots including a first portion extending upwardly from a lower extremity of said plug and a second portion intersecting said first portion and extending laterally therefrom, said bayonet slots slidably engageable with said bayonet pins.

11. The drain closure as in claim 10, wherein said bayonet pins are positioned below said lower extremity of said plug when said plug is urged away from said strainer by said spring.

12. The drain closure as in claim 10, wherein each said bayonet slot first portion tapers outwardly toward the respective second portion proximate said intersection with said respective second portion.

13. A drain plug mechanism for a vessel having a drain hole, said drain plug mechanism for use with a strainer mounted within the drain hole in sealing engagement with the vessel the strainer comprising an upstanding tubular wall having an upper end and a lower end, the tubular wall defining a strainer passage, a spider spanning the strainer passage proximate the wall lower end, the spider including a threaded receiver oriented concentrically with the strainer passage; and an annular strainer flange extending radially outwardly from the tubular wall proximate the wall upper end; said drain plug mechanism comprising:

a) a post having an upper end, a lower end, and a bayonet pin extending outwardly from said post intermediate said post upper and lower ends, said post lower end having external threads for engaging the threaded receiver such that said post extends upwardly from the spider;

b) a drain plug including:

i) a central aperture in sliding engagement with said post, said aperture having an upper end;

ii) a bayonet slot in communication with said central aperture for slidingly engaging said bayonet pin, said bayonet slot including a first portion extending upwardly from a lower extremity of said drain plug and a second portion intersecting said first portion and extending laterally therefrom;

iii) an annular plug flange extending radially outwardly from said plug, said plug flange being sized and shaped to cover the strainer passage;

iv) an elastomeric seal positioned beneath said plug flange for sealingly engaging the strainer flange;

c) a cap covering said aperture upper end and having an internal cavity in communication with said aperture; and d) a compression spring positioned within said cap internal cavity such that a lower end of said spring engages said post upper end and an upper end of said spring engages said cap, said spring biasing said plug upwardly away from the strainer.

14. The drain plug mechanism as in claim 13, wherein said compression spring is a conical helical spring, said lower end being smaller in diameter than said upper end.

15. The drain plug mechanism as in claim 13, wherein said spring extends completely within said internal cavity of said cap.

16. The drain plug mechanism as in claim 13, wherein said post upper end includes a head having a diameter larger than the diameter of said plug aperture.

17. The drain plug mechanism as in claim 16, wherein said head is threadably removable from said post.

18. The drain plug mechanism as in claim 13, wherein said bayonet slot does not engage said bayonet pin when said plug is biased away from the strainer by said compression spring.

19. The drain plug mechanism as in claim 13, wherein said bayonet slot first portion tapers outwardly toward said second portion proximate said intersection with said second portion.

20. A drain closure for a vessel having a drain hole, said drain closure comprising:

a) a strainer sized and shaped for mounting within the drain hole in sealing engagement with the vessel, said strainer comprising:

i) an upstanding tubular wall having an upper end and a lower end, said tubular wall defining a strainer passage;

ii) a spider spanning said strainer passage proximate said wall lower end; and iii) an annular strainer flange extending radially outwardly from said tubular wall proximate said wall upper end;

b) a post having an upper end, a lower end, and a bayonet pin extending outwardly from said post intermediate said post upper and lower ends, said post extending upwardly from said spider in concentric orientation with said strainer passage;

c) a drain plug including:

i) a central aperture in sliding engagement with said post, an upper portion of said aperture having internal threads;

ii) a bayonet slot in communication with said central aperture for slidingly engaging said bayonet pin, said bayonet slot including a first portion extending upwardly from a lower extremity of said drain plug and a second portion intersecting said first portion and extending laterally therefrom;

iii) an annular plug flange extending radially outwardly from said plug, said plug flange being sized and shaped to cover said strainer passage;

iv) an elastomeric seal positioned beneath said plug flange for sealingly engaging said strainer flange;

d) a cap having an internal cavity and external threads in engagement with said internal threads of said plug aperture upper portion; and e) a compression spring positioned within said cap internal cavity such that a lower end of said spring engages said post upper end and an upper end of said spring engages said cap, said spring biasing said plug upwardly away from said strainer.

21. The drain closure as in claim 20, wherein said compression spring is a conical helical spring, said lower end being smaller in diameter than said upper end.

22. The drain closure as in claim 20, wherein said spring extends completely within said cap.

23. The drain closure as in claim 20, wherein said post upper end includes a head having a diameter larger than the diameter of at least a lower portion of said plug aperture.

24. The drain closure as in claim 23, wherein said head is threadably removable from said post.

25. The drain closure as in claim 20, wherein said bayonet slot does not engage said bayonet pin when said plug is biased away from said strainer by said compression spring.

26. The drain closure as in claim 20, wherein said bayonet slot first portion tapers outwardly toward said second portion proximate said intersection with said second portion.

27. A drain plug mechanism for a vessel having a drain hole, said drain plug mechanism for use with a strainer mounted within the drain hole in sealing engagement with the vessel, the strainer including a strainer passage and a receiver positioned within the strainer passage; said drain plug mechanism comprising:

a) a post having a lower end securable to said receiver such that said post extends upwardly therefrom;

b) a plug slidably mounted on said post and selectively closing the strainer passage;

c) a latch selectively latching said plug in a sealed position relative to the strainer;

d) a knob having an internal cavity and connected to said plug above said post; and e) a spring extending into said internal cavity in said knob and engaging said knob and said post to urge said plug away from said strainer.

28. The drain plug mechanism as in claim 27, wherein said spring is a conical helical spring.

29. The drain plug mechanism as in claim 27, wherein said spring extends substantially completely within said cap.

30. The drain plug mechanism as in claim 27, wherein said latch comprises a pair of bayonet pins extending outwardly from said post in opposing transverse directions and a pair of bayonet slots in said plug, each of said bayonet slots including a first portion extending upwardly from a lower extremity of said plug and a second portion intersecting said first portion and extending laterally therefrom, said bayonet slots slidably engageable with said bayonet pins.

31. The drain plug mechanism as in claim 30, wherein said bayonet pins are positioned below said lower extremity of said plug when said plug is urged away from said strainer by said spring.

32. The drain plug mechanism as in claim 30, wherein each said bayonet slot first portion tapers outwardly toward the respective second portion proximate said intersection with said respective second portion.

* * * * *